US007139520B2

(12) United States Patent
Echigo et al.

(10) Patent No.: US 7,139,520 B2
(45) Date of Patent: Nov. 21, 2006

(54) FIXING DEVICE, NIPPING DEVICE, AND IMAGE FORMING APPARATUS

(75) Inventors: Katsuhiro Echigo, Asaka (JP); Shigeo Kurotaka, Sagamihara (JP); Takashi Fujita, Yokohama (JP); Toshihiko Baba, Ota-ku (JP); Hisashi Kikuchi, Kawasaki (JP); Yukimichi Someya, Saitama (JP); Hiroyuki Kunii, Yokohama (JP); Atsushi Nakafuji, Ota-ku (JP)

(73) Assignee: Ricoh Company, Ltd., Tokyo (JP)

( * ) Notice: Subject to any disclaimer, the term of this patent is extended or adjusted under 35 U.S.C. 154(b) by 13 days.

(21) Appl. No.: 10/871,025

(22) Filed: Jun. 21, 2004

(65) Prior Publication Data

US 2005/0025537 A1 Feb. 3, 2005

(30) Foreign Application Priority Data

Jun. 20, 2003 (JP) ..... 2003-177281

(51) Int. Cl.
*G03G 15/20* (2006.01)

(52) U.S. Cl. ..... 399/329; 215/216

(58) Field of Classification Search ..... 219/216, 219/469, 470, 471; 399/328, 329, 320, 335, 399/336

See application file for complete search history.

(56) References Cited

U.S. PATENT DOCUMENTS 4,696,418 A 9/1987 Kurotaka et al.
4,985,733 A 1/1991 Kurotori et al.
4,987,457 A 1/1991 Mochizuki et al.
5,021,834 A 6/1991 Tsuruoka et al.
5,153,651 A 10/1992 Kurotaka
5,155,531 A 10/1992 Kurotori et al.
5,155,534 A 10/1992 Kurotori et al.
5,359,398 A 10/1994 Echigo et al.
5,384,225 A 1/1995 Kurotori et al.
5,456,782 A 10/1995 Fujita et al.
5,463,447 A 10/1995 Kurotori et al.
5,463,453 A 10/1995 Kurotori et al.
5,493,365 A 2/1996 Matsui et al.
5,504,590 A 4/1996 Kawada et al.
5,513,026 A 4/1996 Suzuki et al.
5,566,013 A 10/1996 Suzuki et al.
5,592,275 A 1/1997 Echigo et al.
5,610,725 A 3/1997 Kawada et al.
5,642,188 A 6/1997 Mochizuki et al.
5,652,803 A 7/1997 Tachikawa et al.
5,659,628 A 8/1997 Tachikawa et al.
5,678,158 A 10/1997 Kurotori et al.
5,678,161 A 10/1997 Kurotaka et al.
5,708,949 A 1/1998 Kasahara et al.

(Continued)

FOREIGN PATENT DOCUMENTS

JP 2002-258660 11/2002

*Primary Examiner*—Hoang Ngo
(74) *Attorney, Agent, or Firm*—Oblon, Spivak, McClelland, Maier & Neustadt, P.C.

(57) ABSTRACT

A fixing device including a fixing belt, a drive roller and a press roller. The drive roller is configured to drive the fixing belt, and press roller is arranged so as to face the drive roller across the fixing belt, and exert pressure toward the fixing belt. The drive roller and the press roller are able to rotate so that the peripheral velocity of the drive roller is greater than the peripheral velocity of the press roller. According to the fixing device image defects, including image difference, are less likely to occur when fixing an image on a recording sheet.

32 Claims, 7 Drawing Sheets

U.S. PATENT DOCUMENTS

| | | | |
|---|---|---|---|
| 5,751,854 | A | 5/1998 | Saitoh et al. |
| 5,783,288 | A | 7/1998 | Fujita et al. |
| 6,055,390 | A | 4/2000 | Kurotaka et al. |
| 6,078,766 | A | 6/2000 | Kurotaka |
| 6,088,558 | A | 7/2000 | Yamada et al. |
| 6,108,906 | A | 8/2000 | Fujita et al. |
| 6,122,479 | A | 9/2000 | Fujita et al. |
| 6,150,066 | A | 11/2000 | Kurotori et al. |
| 6,198,888 | B1 | 3/2001 | Kurotaka et al. |
| 6,243,559 | B1 | 6/2001 | Kurotaka et al. |
| 6,262,787 | B1 | 7/2001 | Kamoi et al. |
| 6,272,248 | B1 | 8/2001 | Saitoh et al. |
| 6,347,212 | B1 | 2/2002 | Kosugi et al. |
| 6,366,751 | B1 | 4/2002 | Shakuto et al. |
| 6,501,935 | B1 | 12/2002 | Hirai et al. |
| 6,535,701 | B1 | 3/2003 | Baba |
| 6,542,705 | B1 | 4/2003 | Fujita et al. |
| 6,559,421 | B1 | 5/2003 | Yura et al. |
| 6,625,409 | B1 | 9/2003 | Shakuto et al. |
| 6,631,253 | B1 | 10/2003 | Nakafuji et al. |
| 6,636,718 | B1 | 10/2003 | Yura et al. |
| 6,646,227 | B1 | 11/2003 | Yura et al. |
| 6,654,579 | B1 | 11/2003 | Shakuto et al. |
| 6,721,532 | B1 | 4/2004 | Kosugi et al. |
| 6,795,676 | B1 | 9/2004 | Kikuchi et al. |
| 6,795,678 | B1 | 9/2004 | Yura et al. |
| 2002/0081128 | A1 | 6/2002 | Shakuto et al. |
| 2002/0090229 | A1 | 7/2002 | Shakuto et al. |
| 2003/0099479 | A1 | 5/2003 | Nakafuji et al. |
| 2003/0192869 | A1 | 10/2003 | Yura et al. |
| 2004/0022552 | A1 | 2/2004 | Yura et al. |
| 2004/0037595 | A1 | 2/2004 | Takashi et al. |
| 2004/0086293 | A1 | 5/2004 | Atsushi et al. |

FIXING DEVICE, NIPPING DEVICE, AND IMAGE FORMING APPARATUS

CROSS REFERENCE TO RELATED PATENT DOCUMENTS

This application claims priority to Japanese Patent Application No. JP 2003-177281, filed Jun. 20, 2003, the entire contents of which is entirely incorporated herein by reference

BACKGROUND OF THE INVENTION

1. Field of the Invention

The present invention relates to an image forming apparatus including a copier, a printer, and a facsimile, in which a nipping device and a fixing device are incorporated. The nipping device and the fixing device are used for the image forming apparatus, the nipping device is preferably implemented in coordination with the fixing device.

2. Background of the Invention

Generally, a fixing device for a color image forming apparatus, which is different from that for a black and white image forming apparatus, is designed so that the time of nipping between a fixing roller and a press roller is from 40 ms to 50 ms, or longer. The purpose of this design is to improve the color characteristic by adjusting the brilliance degree on the surface of the fixed toner as desired. The extended nipping time is also desirable in order to obtain a transparent characteristic when the toner is fixed on an over-head projector (OHP) sheet, by melting a plurality of color toner.

In this case, the width in which a paper sheet is nipped between the fixing roller and the press roller becomes large to ensure the appropriate time of nipping. In a roller type fixing device in which the paper sheet is nipped between the fixing roller and the press roller directly, the diameter of the fixing roller and the press roller are enlarged in order to achieve a greater amount of pressure generated between the two rollers. Thus, in order to ensure the strength of the rollers, the cored bar and the elastic layer of the rollers become thick. Accordingly, the time needed to increase the temperature of the rollers becomes long due to their increased size and decreased heat conducting charateristics.

Japanese Patent Laid-Open No. 2002-258660, describes a belt type fixing device for a color image forming apparatus, which shortens the temperature rising time. A fixing belt is used to lower the heat capacity and increase the nipping width. In the belt type fixing device, the fixing belt is wound around the press roller and the pressing belt is wound around the fixing roller In Japanese Patent Laid-Open No. 2002-258660, the fixing belt is suspended by plural support rollers, which are arranged across the fixing belt respectively in order to pinch the fixing belt. The press rollers are also arranged so that the line connecting the rotating axis of the press rollers leans from the vertical line of the fixing belt. Thus, when the press rollers pinch the fixing belt, the press rollers drive the fixing belt, and when the press rollers do not pinch the fixing belt, the support rollers drive the fixing belt. In the fixing device, when the press rollers do not pinch the fixing belt, the velocity of the fixing belt is set higher than the peripheral velocity of the press rollers. The purpose of this velocity setting is to avoid a decrease in pressure between the press rollers because of the slack in the fixing belt shortly after the press rollers pinch the fixing belt.

In the belt type fixing device, it is difficult to accord the velocity of the fixing belt with the peripheral velocity of the press rollers. This is because the belt type fixing device has a wide nipping width. It is known that when the velocity of the fixing belt is not calibrated with the peripheral velocity of the press roller, there occurs an error called 'image difference'. There are plural causes of image difference. One of the causes is thought to be slipping which results from a difference in friction between the fixing belt and recording sheet, and between the recording sheet and the press roller. Another cause is thought to be the difference of velocity which results from bending of the fixing belt where the recording sheet is nipped. Another cause is thought to be the strain of the elastic layer of the support roller and the press roller.

SUMMARY OF THE INVENTION

A general object of the present invention is to provide a fixing device in which image deformities, including image difference, is less likely to occur.

Another general object of the present invention is to provide a nipping device in which image deformities, including image difference, is less likely to occur.

In order to achieve the above mentioned general objects, there is provided according to a first aspect of the present invention, a fixing device having a fixing belt, a drive roller and a press roller. The drive roller is configured to drive the fixing belt. The press roller is arranged so as to face the drive roller across the fixing belt, and is configured to exert pressure toward the fixing belt. The drive roller and the press roller are configured to rotate so that the peripheral velocity of the drive roller is greater than the peripheral velocity of the press roller.

According to a second aspect of the present invention, there is provided a nipping device having a belt, a drive roller and a press roller. The drive roller is configured to drive the belt. The press roller is arranged to face the drive roller across the belt, and is configured to exert pressure toward the belt. The drive roller and the press roller are configured to rotate so that the peripheral velocity of the drive roller is larger than the peripheral velocity of the press roller.

According to a third aspect of the present invention, there is provided a nipping device having a drive roller and a press roller. The press roller is arranged so as to face the drive roller, and configured to exert pressure toward the drive roller. The drive roller and the press roller is configured to rotate so that the peripheral velocity of the drive roller is larger than the peripheral velocity of the press roller.

According to a fourth aspect of the present invention, there is provided a nipping device having a belt, a drive roller, a press roller and a driving power transmission device. The drive roller is configured to drive the belt. The press roller is arranged so as to face the drive roller across the belt, and is configured to exert pressure toward the belt. The driving power transmission device is configured to transmit driving power from one of the drive roller and the press roller to the other and includes gears which mesh with each other. The plural gears are coupled to an end of each of the drive roller and the press roller. The ratio of the number of the cogs of a gear coupled to the press roller to a gear coupled to the drive roller is larger than the ratio of the external diameter of the press roller in relation to the external diameter of the drive roller.

According to a fifth aspect of the present invention, there is provided a nipping device having a belt, a drive roller, a press roller and a driving power transmission device. The drive roller is configured to drive the belt. The press roller is arranged so as to face the drive roller across the belt, and exert pressure toward the belt. The driving power transmission unit is configured to transmit driving power from one of the drive roller and the press roller to the other, and includes a plurality of high friction units which are in contact with each other. The plurality of high friction units are coupled to a end of the drive roller and the press roller. The ratio of the diameter of one of the plurality of high friction units coupled to the press roller to one of the plurality of high friction units coupled to the drive roller is larger than the ratio of the external diameter of the press roller in relation to the drive roller.

According to a sixth aspect of the present invention, there is provided a nipping device having means for guiding a recording sheet; means for driving the guiding means; and means for exerting pressure toward the guiding means, which is arranged so as to face the driving means across the guiding means. The driving means and the means for exerting pressure allows for rotation so that the peripheral velocity of the driving means is larger than the peripheral velocity of the means for exerting pressure.

According to a seventh aspect of the present invention, there is provided a nipping device having means for driving a recording sheet, and means for exerting pressure toward the driving means, which is arranged so as to face the driving means. The driving means and the means for exerting pressure allows for rotation so that the peripheral velocity of the driving means is larger than the peripheral velocity of the exerting pressure means.

According to the above mentioned image forming device, relatively neat images can be formed on a recording medium.

Other objects and further features of the present invention will be apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detained descriptions and accompanying drawings.

DETAILED DESCRIPTION OF THE PREFERRED EMBODIMENTS

Figure 1:
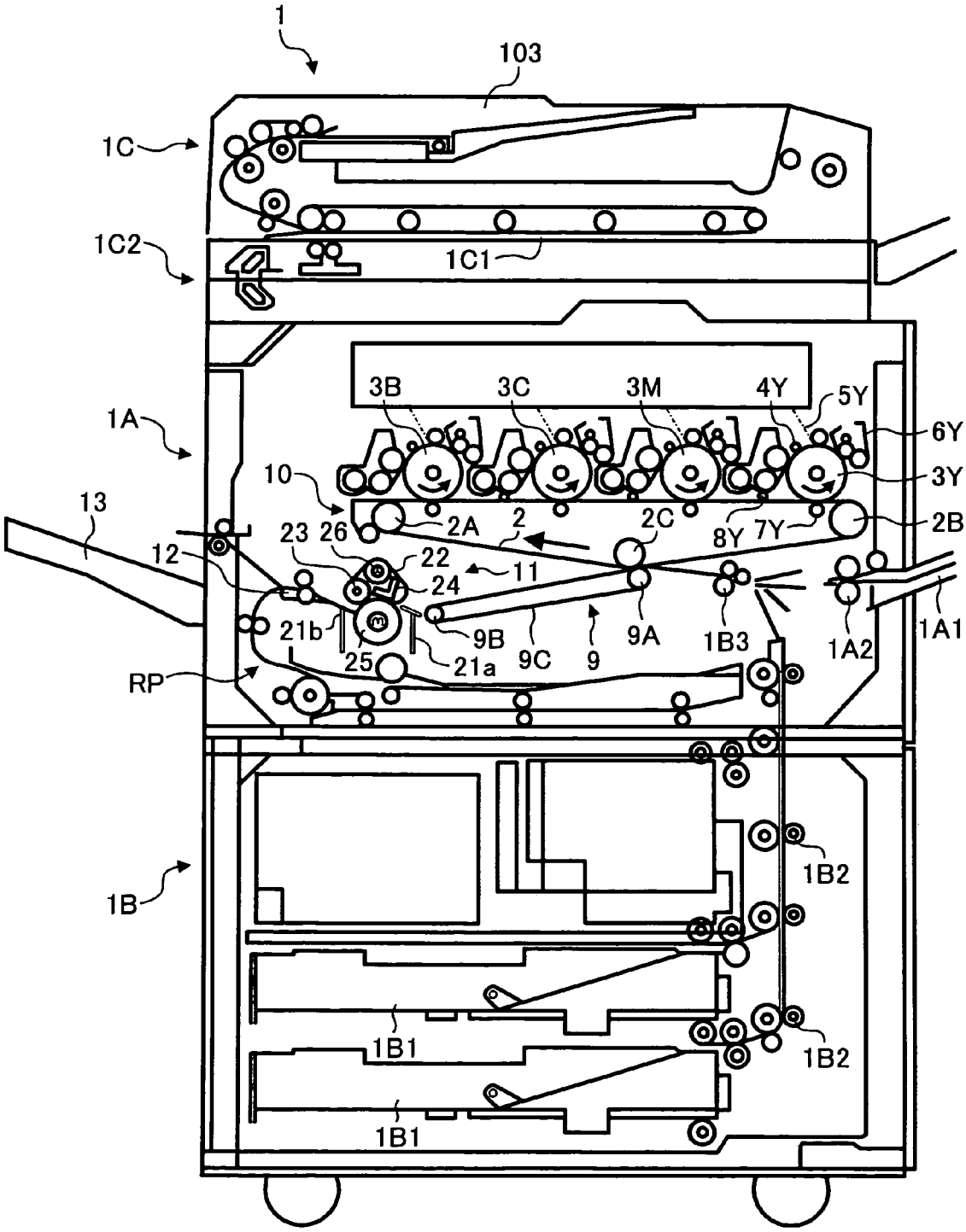
FIG. 1 is a diagram of an image forming apparatus according to a first embodiment of the present invention.

The following comments relate to the drawings, wherein like reference numerals designate identical or corresponding parts throughout the several views.

First Embodiment

FIG. 1 is a diagram of an image forming apparatus according to a first embodiment. The image forming apparatus includes various well known image forming apparatuses including a copier, a facsimile machine, a printer and various other printing machines. A color image forming apparatus is employed as an example of the image forming apparatus in this embodiment. However, it should be noted that the present invention can be applied to black and white image forming apparatus including a copier, a facsimile machine, a printer and various other printing machines.

The color image forming apparatus in this embodiment includes photoconductors, each of which forms a toner image with a color corresponding a separated color from the original image. The color image forming apparatus also includes an intermediate transfer member, on which the toner image on the photoconductors is transferred so that the image can then be superimposed onto a recording medium.

A sheet feeder 1B is arranged in the upper part of a color image forming apparatus 1, and an original sheet scanning unit 1C, having an original sheet mount unit 1C1, is arranged in the lower part of a color image forming apparatus 1. An image forming unit 1A is arranged between the recording sheet feeder 1B and the original sheet scanning unit 1C. The image forming unit 1A has an intermediate transfer belt 2 whose surface is extended in the horizontal direction. Photoconductors 3Y, 3M, 3C and 3B are arranged above the intermediate transfer belt 2 to form images whose colors are complementary colors of the separated colors from the original image respectively.

Each of the photoconductors 3Y, 3M, 3C and 3B forms a toner image whose color is a complementary color of the separated color from the original image. The photoconductors are arranged along the extended surface of the intermediate transfer belt 2 sequentially. Each of the photoconductors 3Y, 3M, 3C and 3B has a drum shape which can rotate in the same direction (countercolockwise in this embodiment). A charging device 4, a writing device 5, a developing device 6, a primary transfer device 7 and a cleaning device 8 are arranged around each photoconductor 3Y, 3M, 3C and 3B, in order to execute image forming operations. The devices arranged around the photoconductor 3Y are delineated as 'Y', in FIG. 1 (e.g., 4Y, 5Y, etc.). The other photoconductors are configured similarly, however these are not indicated by reference numeral as a matter of convenience.

The intermediate transfer belt 2 is arranged around rollers 2A, 2B and 2C, and moves in the same direction as the photoconductors 3 where the intermediate transfer belt 2 and the photoconductors 3 face each other. The extended surface of the intermediate transfer belt 2 is formed by the rollers 2A and 2B, and the roller 2C faces a secondary transfer device 9 across the intermediate transfer belt 2. In addition, a cleaning device 10 for the intermediate transfer belt 2 is arranged around the intermediate transfer belt 2.

The secondary transfer device 9 has a charging drive roller 9A and a driven roller 9B and a transfer belt 9C arranged around the charging drive roller 9A and the driven roller 9B. The transfer belt 9C can move in the same direction as the moving direction of the intermediate transfer belt 2 where the transfer belt 9C and the intermediate transfer belt 2 face each other (a secondary transfer position). The image formed on the intermediate transfer belt 2 is transferred onto the recording sheet by charging the transfer belt 9C with the charging drive roller 9A.

The recording sheet is conveyed to the secondary transfer position from the recording sheet feeder 1B. The recording sheet feeder 1B has plural sheet feeding cassettes 1B1, a plural pair of convey rollers 1B2 arranged on the sheet path, and a pair of registration rollers 1B3 arranged before the secondary transfer position. The color image forming apparatus 1 has a structure configured to convey a sheet that is not stored in the recording sheet feeding cassettes 1B1 to the secondary transfer position. This structure includes a pair of convey rollers 1A2, and a manual sheet feeding tray 1A1 which can be folded and unfolded. The sheet path from the manual sheet feeding tray 1A1 joins the sheet path from the recording sheet feeder 1B. The pair of registration rollers 1B3 adjusts the registration timing of the recording sheet from both the recording sheet feeding cassettes 1B1 and the manual sheet feeding tray 1A1.

The writing device 5 scans each photoconductor 3Y, 3M, 3C and 3B, with the light modulated according to an image information, to form a latent image on the surface of each photoconductor 3Y, 3M, 3C and 3B. The image information can be transmitted from the original sheet scanning unit 1C that scans an original sheet mounted on the original sheet mount unit 1C1. The image information can also be transmitted from a computer.

The original sheet scanning unit 1C has a scanner 1C2 that scans an original sheet mounted on the original sheet mount unit 1C1. An automatic document feeder 1C3 is arranged above the original sheet mount unit 1C1, and has a structure that can feed the original sheet upside down to the original sheet mount unit 1C1. Thus, the original sheet scanning unit 1C is able to scan both sides of the original sheet.

The developing device forms a visible toner image according to the latent image formed on the photoconductors 3 by the writing device 5. The visible toner image on each photoconductors 3 is transferred onto the intermediate transfer belt 2 using superposition, as the primary method of transfer. Then the image on the intermediate transfer belt 2 is transferred to the recording sheet by the secondary transfer device 9. The fixing device 11 then fixes the image on the recording sheet.

The sheet path of the recording sheet on which the image is fixed can be converted by a sheet path selector 12 by selecting one of the sheet paths for a recording sheet discharging tray 13 and for a reversing sheet path RP. The fixing device is described in greater detail below.

As is described above, the latent image is formed on each of the photoconductors 3. The photoconductors are uniformly charged according to the image information transmitted from the original sheet scanning unit 1C that scans an original sheet mounted on the original sheet mount unit 1C1, or from an alternative source. The visible toner image is formed according to the latent image by the developing device 6 and transferred onto the intermediate transfer belt 2. When the visible toner image includes one color, the image on the intermediate transfer belt 2 is transferred onto the recording sheet from the recording sheet feeder 1B. When the visible toner image contains multiple colors, the visible toner image on plural photoconductors 3 is transferred onto the intermediate transfer belt 2 via superposition then the superposed image on the intermediate transfer belt 2 is transferred onto the recording sheet. The image on the recording sheet is fixed by the fixing device 11 and the sheet is conveyed for a recording sheet discharging tray 13 or the pair of registration rollers 1B3 through a reversing sheet path RP.

The movement of the recording sheet around the fixing device 11 is described in detail below. The recording sheet, having an unfixed toner image thereon, is conveyed from the secondary transfer device 9 into the fixing device 11, and raised slightly by a inlet guide plate 21*a*, then nipped by a nipping unit of the fixing device 11. The nipping unit has a press unit 24 and a press roller 25 and a fixing belt 22. The fixing belt 22 has a looped shape. The press unit 24 and the press roller 25 exert pressure on each other across the fixing belt 22. The unfixed toner image on the recording sheet is fixed as the result of pressing and heating. The recording sheet is conveyed by the surface of the fixing belt 22, and the unfixed toner image is fixed. The recording sheet is arranged so that the unfixed toner image faces the fixing belt 22 and the back side of the recording sheet faces the press roller 25. In addition, an outlet guide plate 21*b* is placed around the outlet of the recording sheet from the fixing device.

The process of fixing the unfixed toner image onto the recording by the fixing device 11 is described in greater detail below.

The toner on the recording sheet is heated by the press unit 24 and the fixing belt 22 so that the viscosity of the toner is reduced. Then, the toner penetrates into the fabric of the recording sheet, and the toner and the fabric are fixed to one another once the toner is cooled sufficiently to be solidified. When the temperature of the toner is not more than softening temperature, Ts, at the point the recording sheet departs from the fixing belt 22, the toner will not sufficiently soften and penetrate in to the fabric of the recording sheet. Alternatively, when the temperature of the toner is greater than flow initiation temperature, Tf, at the point the recording sheet departs the fixing belt 22, the demolding characteristic between the recording sheet and the demolding layer of the fixing belt 22 worsens because the viscosity of the toner is too low. When the demolding characteristic becomes worse, toner offset may occur or the recording sheet can enwind around the fixing belt 22. Accordingly, it is preferable to control the temperature of the toner after fixing to be between Ts and Tf. It is optimal to control the temperature of the toner to be a median temperature between Ts and Tf, and to reduce any variation in temperature.

Silicon rubber is used as the material of the fixing belt in well-known belt type fixing devices of image forming apparatuses including copiers, printers, and facsimile machines in which color toners are used. Silicon rubber is used because it has good demolding and elasticity characteristic. The silicon oil is often coated on the fixing belt to improve the demolding and duration characteristics of the fixing belt.

In contrast, oil-less toner having base material (resin) mixed with WAX as mold lubricant in a dispersed manner is used in this embodiment. The fixing belt 22 has a base layer, an elastic layer around the tube and a demolding layer around the elastic layer. The base layer has a shape of a tube and is made of resin, polyimide for example, with suitable heat resistance and mechanical strength characteristics. The elastic layer is made of resin, silicon rubber for example, with suitable heat resistance and elasticity characteristics. The demolding layer is preferably made of a material with heat resistance and small surface energy. Silicon rubber and fluororesin including polytetrafluoroethylene (PTFE), tetrafluoroethylene and perfluoro alkyl vinyl ether copolymer (PFA), ethlene and hexafluoropropylene copolymer (FEP) are examples of materials that may be used as the base material of the demolding layer.

Figure 2:
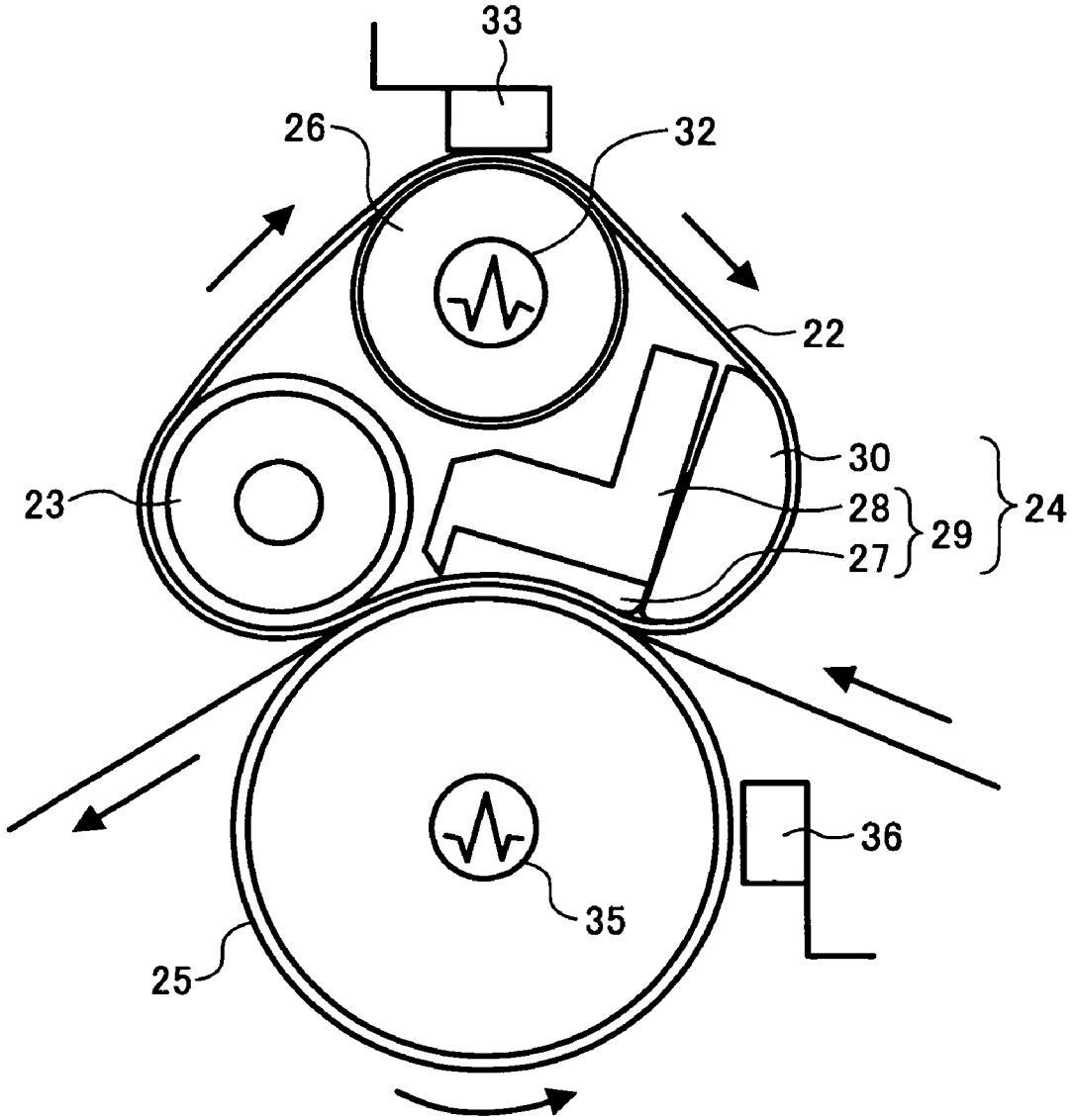
FIG. 2 is an elevational view of a fixing device according to a first embodiment of the present invention.

The structure of the fixing device 11 is described below, drawing reference to FIG. 2, FIG. 3, FIG. 4 and FIG. 5. FIG. 2 is an elevational view of a fixing device according to this embodiment. A heat roller 26, a drive roller 23, a holding unit 29 and a belt guide 30 are arranged around the fixing belt 22. The holding unit 29 has a holding pad 27, and a holder 28. The belt guide 30 guides the fixing belt. The holding unit 29 and the belt guide 30 serve as the press unit 24 that forms a nipping part, where the recording sheet is nipped.

A belt made of heat resistant resin including polyimide and having a thickness of between 50 and 90 micrometers, and a belt made of metal including electrotyped Ni and SUS and having a thickness of between 30 and 50 micrometers can be used as the base layer of the fixing belt 22. The demolding layer forms the surface of the fixing belt 22. The demolding layer is made of heat resistant resin including PTFE, PFA and FEP to ensure the demolding characteristic to the oil-less toner. The elastic layer is placed between the base layer and the demolding layer, in order to make the surface of the fixed toner image, especially toner image including plural colors, smooth without depending on the characteristic of the recording sheet surface. The elastic layer is made of heat resistant rubber including silicon rubber and has a thickness of between 100 and 400 micrometers.

The heat roller 26 is made of metal that has high thermal conductivity, such as aluminum. A halogen heater 32 is placed in the heat roller 26 to serve as a heat source for supplying heat to the fixing belt 22. The inner surface of the heat roller 26 is painted black so that the heat roller 26 efficiently absorbs radiant heat from the halogen heater 32. A thermistor 33 is placed in contact with the surface of the fixing belt 22 and faces the heat roller 26 across the fixing belt 22, to control the temperature of the surface of the fixing belt 22. The heat roller 26 is rotatably fixed to side plates with bearings, and the rotation axis of the heat roller 26 is fixed. The heat roller 26 rotates along the movement of the fixing belt 22 by friction between the heat roller 26 and the fixing belt 22.

The holding pad 27 is made of a elastic material including silicon rubber and foam thereof, and is adhered to the holder 28, made of heat resistant resin, with heat resistant adhesive. The belt guide 30 is attached to the holder 28, so that the fixing belt 22 is led to the nipping part, where the recording sheet is nipped, moving circumferentially with larger radius. The rotation of the drive roller 23 drives the fixing belt 22, and when the radius of the belt guide 30 is too small, it is possible for the fixing belt 22 to slip or to increase the load torque because of increasing of the load resistance of the fixing belt 22. A low friction unit is arranged on the surface of the belt guide 30 and the holding pad 27, which is in contact with the fixing belt 22, so that sliding friction of the fixing belt 22 decreases.

The press roller 25 has a cored bar made of metal including aluminum and ferrum, and a demolding layer that is placed around the cored bar made of heat resistant resin including PFA and PTFE. The toner on the recording sheet is on contact with the press roller 25, when the image is to be formed on both surfaces of the recording sheet. In this case, the demolding layer of the press roller 25 can ensure the demolding characteristic of the toner even when the oil-less toner is used as the toner. The elastic layer is placed between the cored bar and the demolding layer of the press roller 25, in order to make the surface of the fixed toner image, especially toner image including plural colors, smoother without depending on the characteristic of the recording sheet surface. The elastic layer is made of heat resistant rubber including silicon rubber and has a thickness of between 200 micrometers and 1 mm. In addition, the thicker the elastic layer is, the larger the heat capacity of the elastic layer is and the greater the temperature rising time becomes. Accordingly, the thickness of the elastic layer is normally decided based on the quality of the image and the temperature rising time.

A halogen heater 35 is placed in the press roller 25 as a heat source for supplying heat to the press roller 25. A thermistor 36 is placed in contact with the surface of the press roller 25 to control the temperature of the surface of the press roller 25. The inner surface of the press roller 25 is painted black with heat resistant coating material so that the press roller 25 absorbs radiant heat from the halogen heater 35 efficiently. The press roller 25 is rotatably fixed to side plates with bearings and the rotation axis of the press roller 25 is fixed. The press roller 25 rotates with the driving power of a driving device transmitted by a gear system.

The drive roller 23 has a cored bar made of metal including aluminum and ferrum, and an elastic layer that is formed on the cored bar and is made of an elastic material including silicon rubber and foam. The tensile characteristics of the elastic layer are typically determined based on the quality of the image and the heat capacity specification formulated based on the preferred temperature rising time. It is preferable that the elastic layer is thin and has high rubber hardness relatively, when the pressure in the nipping part is set high in order to improve the smoothness of the surface of the color image. When the surface of the image is not smooth enough, it is possible that the defect of the image including satin surface occurs. It is preferable that the thickness of the elastic layer is set between 1 mm and 5 mm, and the ASCA hardness of the elastic layer is set between 50 Hs and 90 Hs, as to the drive roller 23. When the temperature rising time of the image forming apparatus 1 is short, a low heat conduction material such as silicon rubber foam is used for the elastic layer.

The distance between the axis of the drive roller 23 and the axis of the press roller 25 is fixed so that the drive roller 23 and the press roller 25 make contact at a predetermined degree, forming the nipping part. The degree of contact is preferably set in consideration with the thermal expansion of the drive roller 23 and the press roller 25 at the temperature in which the image on the recording sheet can be fixed in order to obtain preferred nipping width in the condition that the distance between the axes is fixed.

Figure 3:
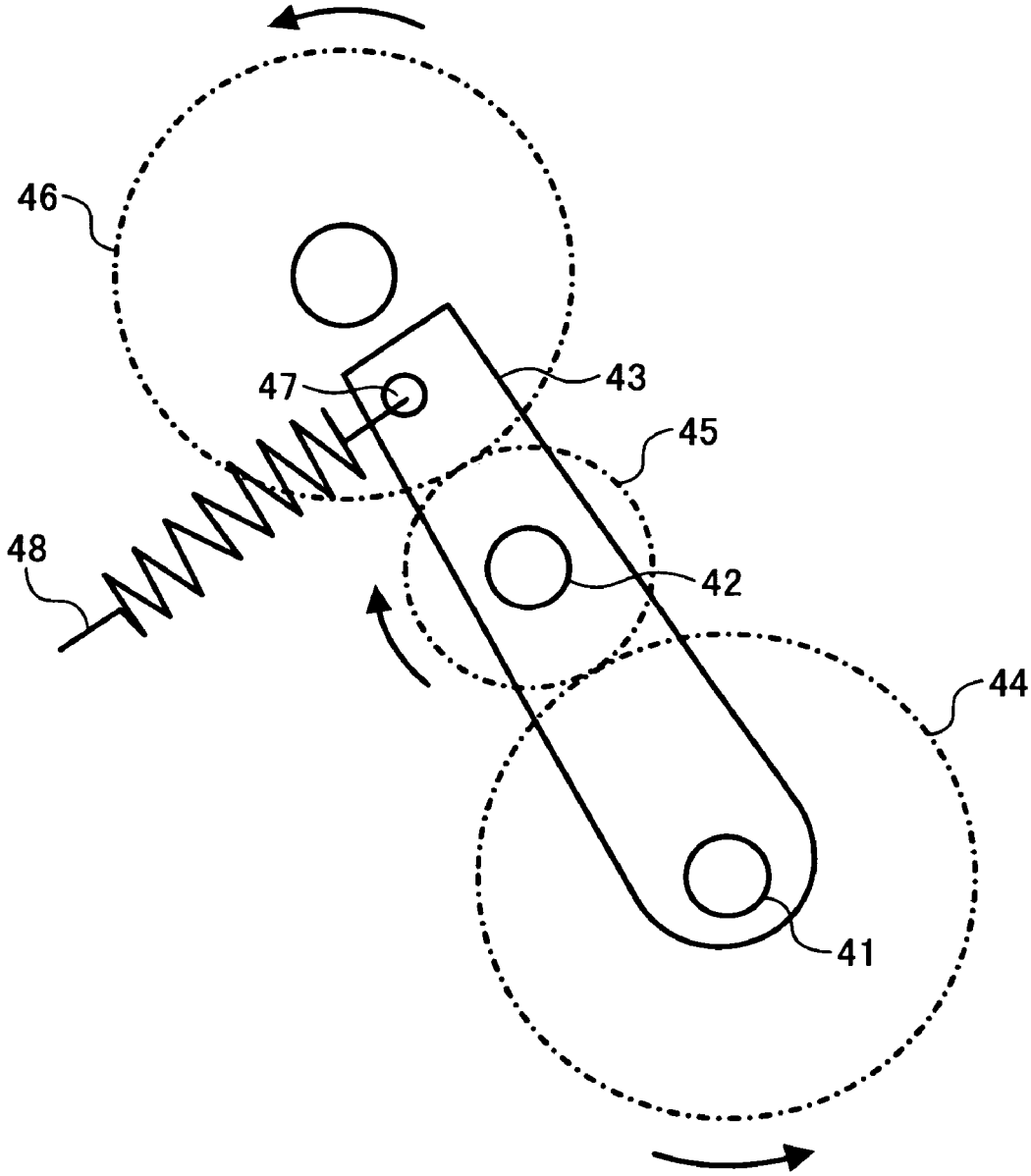
FIG. 3 is an elevational view of a driving unit to drive the drive roller and the press roller according to a first embodiment of the present invention.
Figure 4:
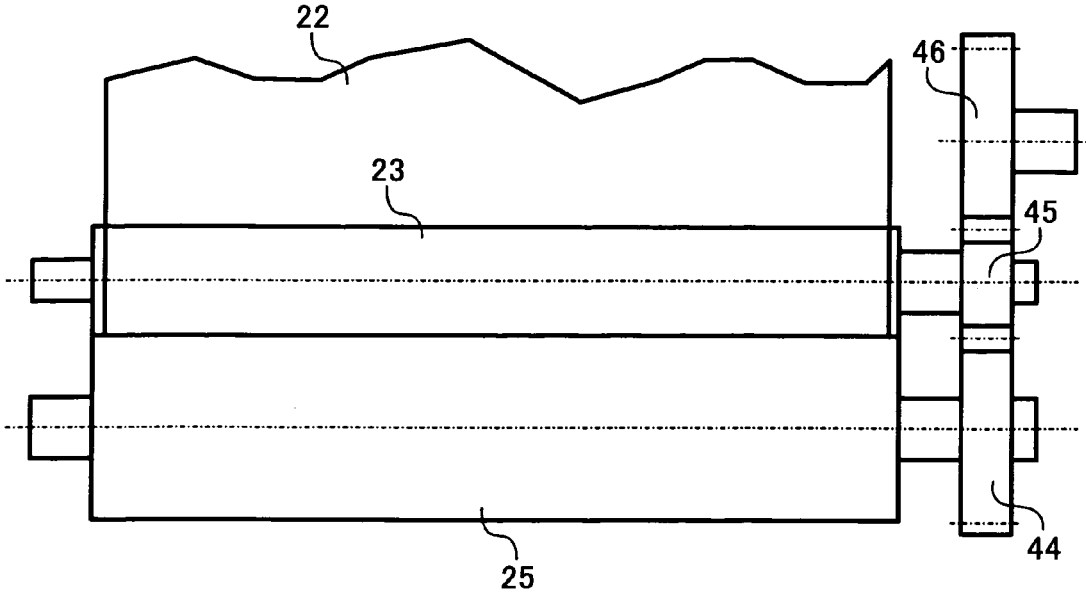
FIG. 4 is a side elevational view of a driving unit to drive the drive roller and the press roller according too a first embodiment of the present invention.

FIG. 3 is an elevational view of a driving unit to drive the drive roller 23 and the press roller 25 in this embodiment. FIG. 4 is a side elevational view of the driving unit to drive the drive roller 23 and the press roller 25 in this embodiment. The position of the axis 41 of the press roller 25 and the axis 42 of the drive roller 23 is fixed by a lever 43. The lever 43 is arranged to be able to rotate, as the axis 41 of the press roller 25 is served as the rotation axis of the lever 43. A press roller gear 44 is arranged on the side, in which the driving unit is placed, of the press roller 25. A drive roller gear 45 is arranged on a side, in which the driving unit is placed, of drive roller 23. The press roller gear 44 and the drive roller gear 45 are meshed with each other. A main body driving gear 46 is connected to a driving device, including a motor, and meshed with the drive roller gear 45. Thus, the main body driving gear 46 driven by the driving device drives the drive roller gear 45, and the drive roller gear 45 drives the press roller gear 44. In addition, the drive roller gear 45 and the press roller gear 44 serve as a drive power transmission unit. The lever 43 has a spring hook 47 and a tension spring 48 is hooked on the spring hook 47. The tension spring 48 pulls the lever 47 toward substantially vertical direction of the lever 43, so that the driving power of the drive roller 23 is transmitted to the fixing belt 22 efficiently. In addition, the distance between the axis of the drive roller 23 and the axis of the press roller 25 does not change depending on the tension from the tension spring 48. Accordingly, the nipping width and the pressure between the drive roller 23 and the press roller 25 are stabilized.

The friction coefficient between the surfaces of the drive roller 23 and the fixing belt 22 is greater than the friction coefficient between the surfaces of the press roller 25 and the fixing belt 22, in order to reduce the risk of slip when driving the fixing belt 22. It is preferable that the external diameter of the press roller 25 and the drive roller 23 are selected in relation to the predetermined fixing temperature at which the image on the recording sheet is fixed in order to take in to consideration the thermal expansion of the press roller 25 and the drive roller 23. In this embodiment, the fixing belt has a base layer having a thickness of 70 micrometers, an elastic layer having a thickness of 200 micrometers and a demolding layer having a thickness of 30 micrometers. Thus, the fixing belt has a thickness of 300 micrometers in total. The external diameter of the press roller 25 at the fixing temperature is set between 39.8 mm and 40.0 mm. The external diameter of the drive roller 23 at the fixing temperature is set between 23.9 mm and 24.1 mm. The number of cogs of press roller gear 44 is 40, and the number of cogs of drive roller gear 45 is 24. In this case, the velocity of the fixing belt 22 is substantially same as the peripheral velocity of the press roller 25 in the nipping part. The velocity of the fixing belt 22 is larger than the peripheral velocity of the press roller 25 by not more than 3.4 percent of the peripheral velocity of the press roller 25 in the nipping part, when the thickness of the fixing belt 22 is less than 300 micrometers.

The combinations of the external diameter of the press roller 25 and the drive roller are as is described below, for example.

(1) The external diameter of the press roller 25 at the fixing temperature is set 39.8 mm and the external diameter of the drive roller 23 at the fixing temperature is set 23.9 mm. The driving device drives the main body driving gear 46 so that the peripheral velocity of the press roller 25 is 200.0 mm/sec. In this case, the peripheral velocity of the drive roller 23 is 200.1 mm/sec. In addition, the external diameters of the press roller 25 and the drive roller before the thermal expansion are 39.6 mm and 23.8 mm, respectively. In this case, the peripheral velocities of the press roller 25 and the drive roller 23 are 199.0 mm/sec and 199.3 mm/sec, respectively.

(2) The external diameters of the press roller 25 and the drive roller 23 at the fixing temperature are set 39.9 mm and 24.0 mm, respectively. In this case, the peripheral velocities of the press roller 25 and the drive roller 23 are 200.5 mm/sec and 201.0 mm/sec, respectively.

(3) The external diameters of the press roller 25 and the drive roller 23 at the fixing temperature are set 40.0 mm and 24.1 mm, respectively. In this case, the peripheral velocities of the press roller 25 and the drive roller 23 are 201.0 mm/sec and 201.8 mm/sec, respectively.

The recording sheet on which the toner image is formed is conveyed at substantially same velocity as the velocity of the fixing belt 22. This velocity is based on the temperature at which the image on the recording sheet can be fixed, in relation to the viscosity of the toner. The press roller 25 slips on the surface of the recording sheet, when the peripheral velocity of the press roller 25 is smaller than the velocity of the fixing belt 22.

The number of cogs of press roller gear 44 can be set 41 instead of 40, and the number of cogs of drive roller gear 45 can be set 23 instead of 24. In these cases, the peripheral velocity of the drive roller 23 is larger than the peripheral velocity of the press roller 25. The difference of the peripheral velocity between the drive roller 23 and the press roller 25 can be adjusted by modifying the external diameter of the drive roller 23 and the press roller 25.

As is described above, the ratio of the number of the cogs of the press roller gear 44 to the drive roller gear 45 is larger than the ratio of the external diameter of the press roller 25 to the drive roller 23, in this embodiment.

Figure 5:
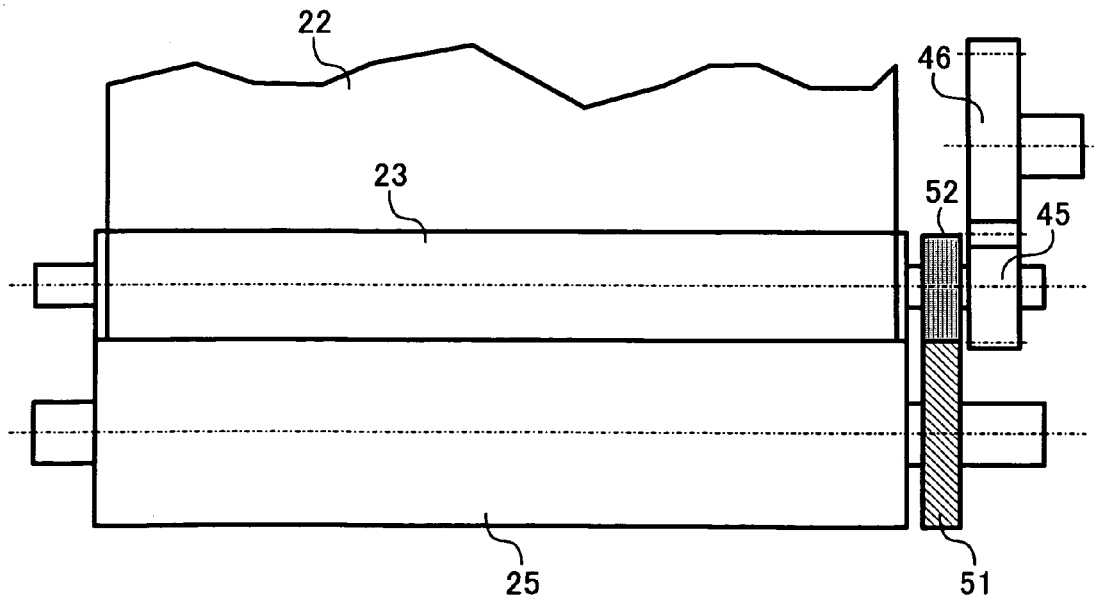
FIG. 5 is a side elevational view of a driving unit to drive the drive roller and the press roller according to a first embodiment of the present invention.

FIG. 5 is a side elevational view of the alternative of the driving unit to drive the drive roller 23 and the press roller 25 in this embodiment. As is described in FIG. 5, high friction units 51 and 52, whose friction coefficient are higher than the press roller 25 and the drive roller 23 respectively, can be placed on the side of the press roller 25 and the drive roller 23 on which the driving unit is placed. Thus, the drive power is transmitted from the drive roller 23 to the press roller 25 via the friction between the high friction unit 51 and the high friction unit 52. In addition, the high friction unit 51 and the high friction unit 52 are served as a drive power transmission unit. In this case, the difference of the peripheral velocity between the drive roller 23 and the press roller 25 can be adjusted by modifying the external diameter of the high friction units 51 and 52. For example, it is preferable that the ratio of the diameter of the high friction unit 51 to the diameter of the high friction unit 52 is larger than the ratio of the external diameter of the press roller 25 to the external diameter of the drive roller 23

Second Embodiment

Figure 6:
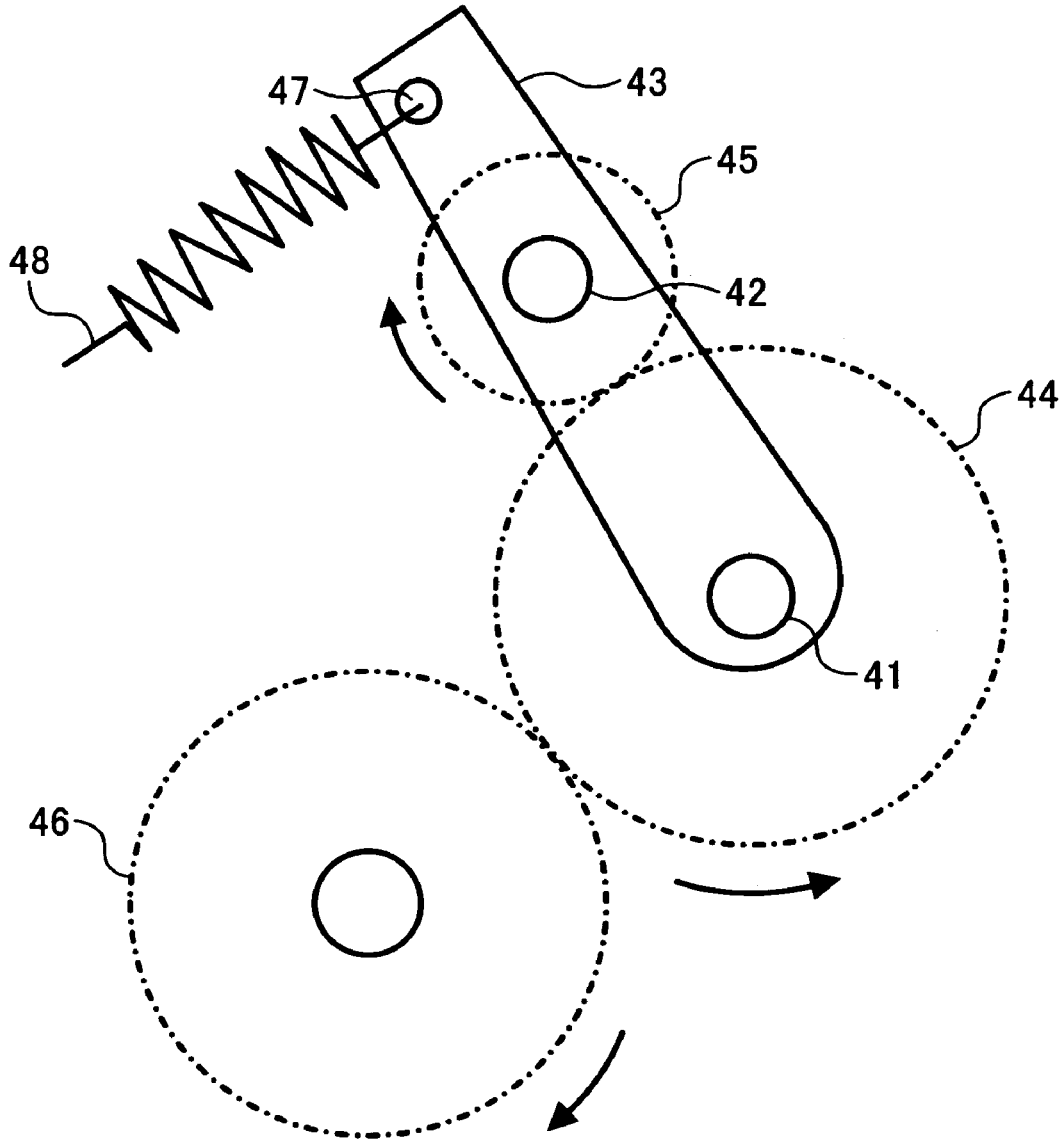
FIG. 6 is an elevational view of a driving unit to drive the drive roller and the press roller according to a second embodiment of the present invention.
Figure 7:
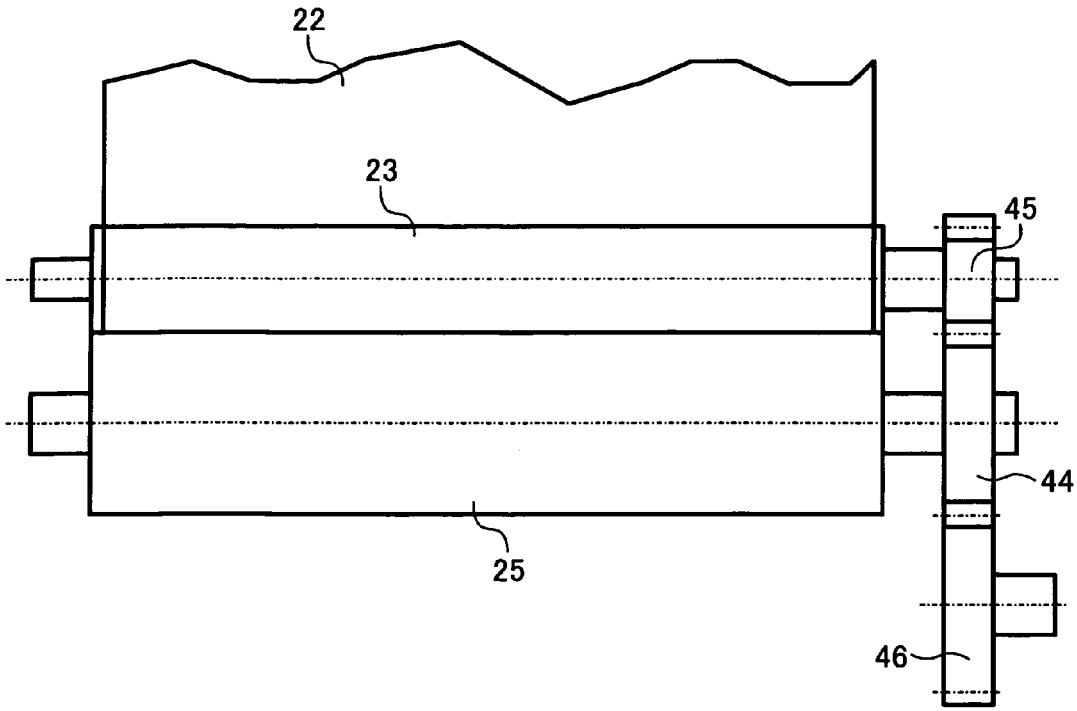
FIG. 7 is a side elevational view of a driving unit to drive the drive roller and the press roller according to a second embodiment of the present invention.
Figure 8:
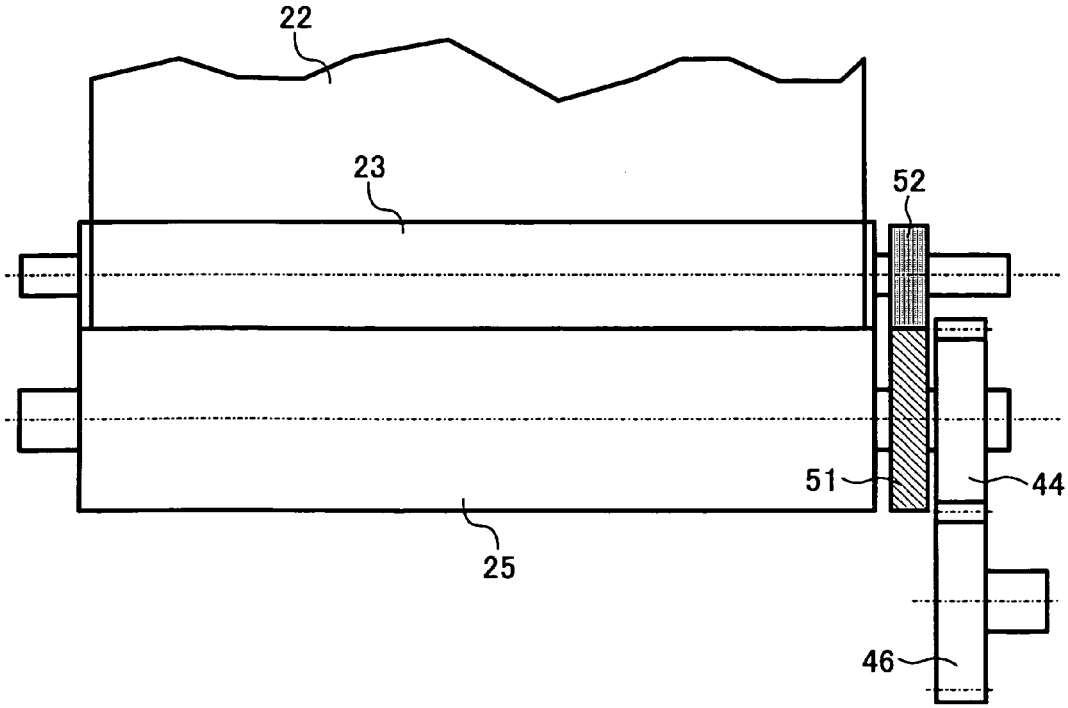
FIG. 8 is a side elevational view of a driving unit to drive the drive roller and the press roller according to a second embodiment of the present invention.

Then the structure of the fixing device 11 in the second preferred embodiment is described below, and is illustrated in FIGS. 6–8. In the first embodiment, the driving power of the drive roller 23 is transmitted to the press roller 25. However, in the present embodiment, the driving power of the press roller 25 is transmitted to the drive roller 23. The drive roller 23 drives the fixing belt 22 with the friction between the drive roller 23 and the fixing belt 22, as described in accordance with first embodiment.

FIG. 6 is an elevational view of a driving unit to drive the drive roller 23 and the press roller 25 in this embodiment. FIG. 7 is a side elevational view of the driving unit to drive the drive roller 23 and the press roller 25 in this embodiment.

The press roller gear 44 and the drive roller gear 45 are engaged with each other, and the main body driving gear 46 is connected to the driving device and engaged with the press roller gear 44. Thus, the main body driving gear 46 driven by the driving device drives the press roller gear 44, and the press roller gear 44 subsequently drives the drive roller gear 45. The lever 43 has a spring hook 47 and a tension spring 48 is hooked on the spring hook 47. The tension spring 48 pulls the lever 47 in the vertical direction of the lever 43, so that the driving power of the press roller 25 is efficiently transmitted to the fixing belt 22.

The friction coefficient between the surfaces of the drive roller 23 and the fixing belt 22 is set larger than the friction coefficient between the surfaces of the press roller 25 and the fixing belt 22, as in the first embodiment. The recording sheet on which the toner image is formed is nipped between the fixing belt 22 and the press roller 25. The recording sheet is conveyed at substantially the same velocity as the velocity of the fixing belt 22, at the temperature in which the image on the recording sheet can be fixed based on the viscosity of the toner. The press roller 25 slips on the surface of the recording sheet, when the peripheral velocity of the press roller 25 is smaller than the velocity of the fixing belt 22.

The number of cogs of press roller gear 44 is 40, and the number of cogs of drive roller gear 45 is 24. The external diameter of the press roller 25 and the drive roller 23 can be set in the same manner as the first embodiment.

Alternatively, the number of cogs of press roller gear 44 can be set 41 instead of 40. And the number of cogs of drive roller gear 45 can be set 23 instead of 24. In these cases, the peripheral velocity of the drive roller 23 is larger than the peripheral velocity of the press roller 25. The difference of the peripheral velocity between the drive roller 23 and the press roller 25 can be adjusted by adjusting the external diameter of the drive roller 23 and the press roller 25.

FIG. 8 is a side elevational view of the alternative of the driving unit to drive the drive roller 23 and the press roller 25 in this embodiment. As is described in FIG. 8, high friction units 51 and 52, whose friction coefficients are higher than the press roller 25 and the drive roller 23 respectively, can be placed on the side of the press roller 25 and the drive roller 23, on which the driving unit is placed. Thus, the drive power is transmitted from the drive roller 23 to the press roller 25 via the friction between the high friction unit 51 and the high friction unit 52. In this case, the difference of the peripheral velocity between the drive roller 23 and the press roller 25 can be adjusted by adjusting the external diameter of the high friction unit 51 and the high friction unit 52.

In this embodiment, the structure of the image forming apparatus, with the exception of that described above, is substantially similar to the structure described in relation to the first embodiment.

Third Embodiment

Figure 9:
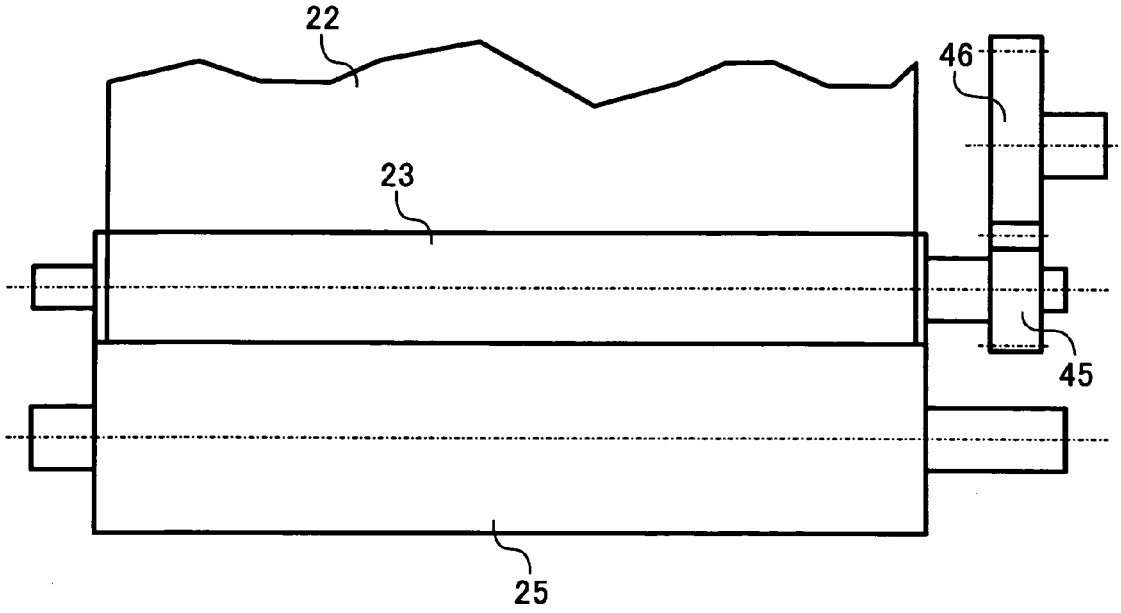
FIG. 9 is a side elevational view of a driving unit to drive the drive roller and the press roller according to a third embodiment of the present invention.

The structure of the fixing device 11 according to a third preferred embodiment is described below, in relation to FIG. 9. FIG. 9 is a side elevational view showing an alternative configuration of the driving unit to drive the drive roller 23 and the press roller 25 according to a third embodiment. In the first embodiment, the driving power of the drive roller 23 is transmitted to the press roller 25. However, in the present embodiment, the driving power of the drive roller 23 is transmitted to the fixing belt 22, via the friction between the drive roller and the fixing belt 22. The fixing belt 22 drives the press roller 25, by way of the friction between the fixing belt 22 and the press roller 25.

The friction coefficient between the surfaces of the drive roller 23 and the fixing belt 22 is set larger than the friction coefficient between the surfaces of the press roller 25 and the fixing belt 22, as in the first and second embodiment. The recording sheet on which the toner image is formed is nipped between the fixing belt 22 and the press roller 25. The recording sheet is conveyed at substantially the same velocity as the velocity of the fixing belt 22 at the temperature at which the image on the recording sheet can be fixed, based on the viscosity of the toner. The press roller 25 slips on the surface of the recording sheet when the peripheral velocity of the press roller 25 is smaller than the velocity of the fixing belt 22.

In this embodiment, the structure of the image forming apparatus, with the exception of that described above, is substantially similar to the structure described in relation to the first embodiment.

In addition, the present invention can be applied to a nipping device and a fixing device that do not have a fixing belt. In this case, the press roller exerts the pressure toward the drive roller and the nipping part is formed between the press roller and the drive roller, normally.

According to the present invention, there is provided a fixing device in which abnormal image including image difference is less likely to occur. There is also provided a nipping device in which abnormal image including image difference is less likely to occur. Also, according to the present invention, there is provided an image forming apparatus which can form relatively neat image on a recording medium.

Obviously, numerous modifications and variations of the present invention are possible in light of the above teachings. It is therefore to be understood that within the scope of the appended claims, the invention may be practiced otherwise than as specifically described herein.

The invention claimed is:

1. A fixing device, comprising:

a fixing belt;

a drive roller configured to drive said fixing belt; and a press roller arranged so as to face said drive roller across said fixing belt, and configured to exert pressure toward said fixing belt, wherein said drive roller and said press roller are configured to rotate so that the peripheral velocity of said drive roller is greater than the peripheral velocity of said press roller.

2. The fixing device of claim 1, wherein said fixing belt is configured to move at substantially the same velocity as the peripheral velocity of said press roller.

3. The fixing device of claim 2, wherein said fixing belt configured to move at a velocity greater than the peripheral velocity of said press roller, said velocity of said fixing belt being no more than 3.4 percent greater than the peripheral velocity of said press roller.

4. The fixing device of claim 1, further comprising:

a driving power transmission device configured to transmit driving power from one of said drive roller and said press roller to the other.

5. The fixing device of claim 1, wherein the friction coefficient between said drive roller and said fixing belt is greater than the friction coefficient between said press roller and said fixing belt.

6. The fixing device of claim 4, wherein said driving power transmission device is configured to transmit driving power from said drive roller to said press roller, and said drive roller is configured to drive said fixing belt via the friction between said drive roller and said fixing belt.

7. The fixing device of claim 4, wherein said driving power transmission device is configured to transmit driving power from said drive roller to said press roller, and said drive roller is configured to drive said fixing belt via the friction between said drive roller and said fixing belt.

8. The fixing device of claim 4, wherein said driving power transmission device includes a plurality of gears which mesh with each other, and said plurality of gears are coupled to an end of each of said drive roller and said press roller.

9. The fixing device of claim 4, wherein said driving power transmission device includes a plurality of high friction units which contact with each other, and said plurality of high friction units are coupled to an end of each of said drive roller and said press roller.

10. The fixing device of claim 5, wherein said drive roller is configured to transmit driving power to said fixing belt via friction between said drive roller and said fixing belt, and said fixing belt is configured to drive said press roller by the friction between said fixing belt and said press roller.

11. A nipping device, comprising:

a belt;

a drive roller configured to drive said belt; and a press roller arranged so as to face said drive roller across said belt, and configured to exert pressure toward said belt, wherein said drive roller and said press roller are configured to rotate so that the peripheral velocity of said drive roller is greater than the peripheral velocity of said press roller.

12. The nipping device of claim 11, wherein said belt is configured to move at substantially the same velocity as the peripheral velocity of said press roller.

13. The nipping device of claim 12, wherein said belt is configured to move at a velocity greater than the peripheral velocity of said press roller, said velocity of said fixing belt being no more than 3.4 percent greater than the peripheral velocity of said press roller.

14. The nipping device of claim 11, further comprising:

a driving power transmission device configured to transmit driving power from one of said drive roller and said press roller to the other.

15. The nipping device of claim 11, wherein the friction coefficient between said drive roller and said belt is greater than the friction coefficient between said press roller and said belt.

16. The nipping device of claim 14, wherein said driving power transmission device is configured to transmit driving power from said drive roller to said press roller, and said drive roller is configured to drive said belt by the friction between said drive roller and said belt.

17. The nipping device of claim 14, wherein said driving power transmission device is configured to transmit driving power from said drive roller to said press roller, and said drive roller is configured to drive said belt via the friction between said drive roller and said belt.

18. The nipping device of claim 14, wherein said driving power transmission device includes a plurality of gears which mesh with each other, and said plurality of gears are coupled to an end of each of said drive roller and said press roller.

19. The nipping device of claim 14, wherein said driving power transmission device includes a plurality of high friction units which contact with each other, and said plurality of high friction units are coupled to an end of each of said drive roller and said press roller.

20. The nipping device of claim 15, wherein said drive roller is configured to transmit driving power said belt via friction between said drive roller and said belt, and said belt is configured to drive said press roller via the friction between said belt and said press roller.

21. A nipping device, comprising:

a drive roller; and a press roller arranged so as to face said drive roller, and configured to exert pressure toward said drive roller, wherein said drive roller and said press roller are configured to rotate so that the peripheral velocity of said drive roller is greater than the peripheral velocity of said press roller.

22. The nipping device of claim 21, further comprising:

a fixing device, wherein said nipping device is part of a fixing device.

23. A nipping device, comprising:

a belt;

a drive roller configured to drive said belt;

a press roller arranged so as to face said drive roller across said belt, and configured to exert pressure toward said belt; and a driving power transmission device configured to transmit driving power from one of said drive roller and said press roller to the other, wherein said driving power transmission device includes a plurality gears which mesh with each other, and said plurality of gears are coupled to an end of each of said drive roller and said press roller, wherein the ratio of the number of the cogs of a gear of said plurality of gears which is coupled to said press roller to the cogs of a a gear of said plurality of gears which is coupled to said drive roller is greater than the ratio of the external diameter of said press roller to the external diameter of said drive roller.

24. The nipping device of claim 23, wherein said nipping device is part of a fixing device, and said belt is a fixing belt.

25. A nipping device, comprising:

a belt;

a drive roller configured to drive said belt;

a press roller arranged so as to face said drive roller across said belt, and configured to exert pressure toward said belt; and a driving power transmission device configured to transmit driving power from one of said drive roller and said press roller to the other, wherein said driving power transmission device includes plurality of high friction units which are in contact with each other, and said plurality of high friction units are coupled to a end of each of said drive roller and said press roller, wherein the ratio of the diameter of one of said plurality of high friction units which is coupled to said press roller to the diameter of one of said plurality of high friction units which is coupled to said drive roller is greater than the ratio of the external diameter of said press roller to the external diameter of said drive roller.

26. The nipping device of claim 25, wherein said nipping device is part of a fixing device, and said belt is a fixing belt.

27. A nipping device, comprising:

means for guiding a recording sheet;

means for driving said guiding means; and means for exerting pressure toward said guiding means, which is arranged to face said driving means across said guiding means, wherein said driving means and said means for exerting pressure rotate, and the peripheral velocity of said driving means is greater than the peripheral velocity of said means for exerting pressure.

28. An image forming apparatus, comprising:

a fixing device, said fixing device comprising:

a fixing belt;

a drive roller configured to drive said fixing belt; and a press roller arranged so as to face said drive roller across said fixing belt, and configured to exert pressure toward said fixing belt and said drive roller, wherein said drive roller and said press roller are configured to rotate so that the peripheral velocity of said drive roller is greater than the peripheral velocity of said press roller.

29. An image forming apparatus, comprising:

a nipping device, said nipping device comprising:

a belt;

a drive roller configured to drive said belt; and a press roller arranged so as to face said drive roller across said belt, and configured to exert pressure toward said belt and said driver roller, wherein said drive roller and said press roller are configured to rotate so that the peripheral velocity of said drive roller is greater than the peripheral velocity of said press roller.

30. An image forming apparatus, comprising:

a nipping device, said nipping device comprising:

a drive roller; and a press roller arranged so as to face said drive roller, and configured to exert pressure toward said drive roller, wherein said drive roller and said press roller are configured to rotate so that the peripheral velocity of said drive roller is greater than the peripheral velocity of said press roller.

31. An image forming apparatus, comprising:

a nipping device, said nipping device comprising:

a belt;

a drive roller configured to drive said belt;

a press roller arranged so as to face said drive roller across said belt, and configured to exert pressure toward said belt; and a driving power transmission device configured to transmit driving power from one of said drive roller and said press roller to the other, wherein said driving power transmission device includes a plurality gears which mesh with each other, and said plurality of gears are coupled to an end of each of said drive roller and said press roller, wherein the ratio of the number of the cogs of a gear of said plurality of gears which is coupled to said press roller to the cogs of a gear of said plurality of gears which is coupled to said drive roller is greater than the ratio of the external diameter of said press roller to the external diameter of said drive roller.

32. An image forming apparatus, comprising:

a nipping device, said nipping device comprising:

a belt;

a drive roller configured to drive said belt;

a press roller arranged so as to face said drive roller across said belt, and configured to exert pressure toward said belt; and a driving power transmission device configured to transmit driving power from one of said drive roller and said press roller to the other, wherein said driving power transmission device includes plurality of high friction units which are in contact with each other, and said plurality of high friction units are coupled to a end of each of said drive roller and said press roller, wherein the ratio of the diameter of one of said plurality of high friction units which is coupled to said press roller to the diameter of one of said plurality of high friction units which is coupled to said drive roller is greater than the ratio of the external diameter of said press roller to the external diameter of said drive roller.

* * * * *